United States Patent [19]

Challand

[11] Patent Number: 4,646,960

[45] Date of Patent: Mar. 3, 1987

[54] HINGED LID PACK WITH LID OPENING ARRANGEMENT

[75] Inventor: Ian Challand, Orpington, England

[73] Assignee: Fabriques de Tabac Reunies, S.A., Neuchatel, Switzerland

[21] Appl. No.: 792,866

[22] Filed: Oct. 30, 1985

[30] Foreign Application Priority Data

Nov. 12, 1984 [GB] United Kingdom ..... 8428567

[51] Int. Cl.[4] ..... B65D 5/66

[52] U.S. Cl. ..... 229/44 CB; 206/273; 229/9; 229/19

[58] Field of Search ..... 206/249, 250, 268, 270, 206/273, 804; 229/44 CB, 19, 20, 9, 11

[56] References Cited

U.S. PATENT DOCUMENTS

| | | | |
|---|---|---|---|
| 3,311,283 | 3/1967 | Shimada et al. | 229/20 |
| 3,933,299 | 1/1976 | Shimada et al. | 229/20 |
| 4,049,117 | 9/1977 | Grimm | 229/19 |
| 4,240,548 | 12/1980 | Stio | 206/250 |
| 4,267,926 | 5/1981 | Toimil | 206/268 |

FOREIGN PATENT DOCUMENTS

| | | | |
|---|---|---|---|
| 598061 | 11/1977 | Switzerland | 206/250 |
| 508466 | 6/1939 | United Kingdom . | |
| 979302 | 1/1965 | United Kingdom | 229/19 |

*Primary Examiner*—William Price
*Assistant Examiner*—Gary E. Elkins
*Attorney, Agent, or Firm*—Jeffrey H. Ingerman

[57] ABSTRACT

The invention provides a cigarette pack comprising an inner slide 13, having a hinged lid, slidable in an outer shell 11. The inner slide has a tongue 39, formed into a first hook, cut from its rear wall 19 and depending from the top wall 21 of the lid of the inner slide. On the inner slide being pushed up and partially out of the outer shell, the first hook engages with a flap 67 formed into a second hook on the rear wall 61 of the outer shell. The action of the tongue on the lid of the inner slide causes it to open, exposing the cigarettes within the pack.

10 Claims, 10 Drawing Figures

HINGED LID PACK WITH LID OPENING ARRANGEMENT

This invention relates to a novel pack, especially suitable for cigarettes and other smoking articles, of the "slide and shell" type, and to a method and apparatus for the production of such packs.

In the past, "slide and shell" type packs have been provided for cigarettes, in which the cigarettes are carried in an inner slide which has a lid portion extending from its upper edge to cover its open upper end. The slide is surrounded by, and slidable in, a tubular outer shell. The inner slide must be pushed up within the outer shell to expose the lid, which is then opened to give access to the cigarettes.

Designs have been proposed in which the lid, by interaction between the inner slide and the outer shell, may be opened by the action of pushing the inner slide up relative to the outer shell.

One such proposal is shown in U.S. Pat. No. 4,267,926 of Fabriques de Tabac Reunies S.A. (filed July 19, 1979, published May 19, 1981). In this pack, the rear wall of the inner slide is cut to provide a tongue depending from the top wall of the slide, which is bent up and glued to the inner surface of the outer shell. As the slide is pushed up in the shell, the tongue not only prevents the slide from leaving the shell, but causes the lid of the slide to open. However, the gluing of the tongue to the inner surface of the outer shell is difficult and expensive to achieve at high production speeds compared with the production of standard hinged lid cigarette packs. Another proposal is that shown in U.S. Pat. No. 3,311,283 of Shimada and Shimada (filed Nov. 30, 1964, published Mar. 28, 1967). In this pack, an extension of the card blank forming the pack is folded back at the front edge of the lid to pass over the top wall of the inner slide and inside the outer shell to lie between the rear walls of the inner slide and the outer shell. The lower portion of this extension is cut to form a hook, which can engage with another hook formed at the upper edge of the rear wall of the outer shell by an extension of the wall folded inside the shell. As the inner slide is pushed up, the two hooks engage, opening the lid and preventing the slide from leaving the shell. This design of pack suffers the disadvantages that it employs considerably more card than conventional hinged lid cigarette packs, and that, if both the front face of the slide and the upper face of the lid are to carry printing, both sides of the blank must be printed on. This is a considerable expense and inconvenience. According to the invention there is provided a pack of smoking articles comprising an inner slide and an outer shell, said inner slide comprising: a bottom wall; opposed side walls and a rear wall extending from said bottom wall and comprising upper and lower portions, said rear wall having an upper edge; and a top wall attached to said upper edge of said rear wall along a first fold line, said top wall forming, together with said upper portion of said rear wall, a lid; in which a first tongue is formed of both said upper and lower portions of said rear wall and is attached to said inner slide portion at its upper end, said first tongue having upper and lower ends, said lower end of said tongue being folded toward said lid to form a first hook, and said outer shell comprising opposed side shell walls and opposed front and rear shell walls, a flap extending from said upper edge of said rear shell wall folded inside said shell to form a second hook for engagement with said first hook of said inner slide, whereby, when said inner slide is inside said outer shell and is moved upwards, said first hook engages said second hook to cause said lid of said inner slide to open along a second fold line extending across said rear wall of said inner slide between said upper and lower portions thereof.

In a preferred embodiment, the first tongue is formed of an upper tongue portion and a lower tongue portion wider than said upper tongue portion, and the lower tongue portion is folded toward the lid to form the first hook.

In a particularly preferred embodiment, one or more further tongues are formed in the lower portion of the rear wall of the inner slide and are bent toward the lid to form stopping tabs for engagement with a second hook on the rear wall of the outer shell when the lid is fully opened.

In the most preferred embodiment, the top wall of the inner slide is wider than the rear wall of the outer shell, to prevent the top wall of the inner side from passing into the outer shell.

There is also provided, according to a second aspect of the invention, apparatus particularly adapted for the production of packs according to the invention from card blanks. In particular, there is provided apparatus for producing cigarette packs from blanks comprising: a blank bed for carrying blanks to be formed into the said pack, said bed comprising a shoe for contacting a blank to restrain the blank against movement, and prongs, corresponding to tabs cut in the said blank, for pushing said tabs out of the plane of the blank against the restraint of the shoe; and a sealer bed comprising a plurality of pockets, each having side walls and a bottom wall and being open at opposed ends and at their upper faces, to which blanks are introduced from said blank bed and into which they are formed for receipt of a bundle of smoking articles, in which said side walls of each of said pockets are chamfered to slope down toward said bottom wall, and terminate in a vertical portion extending to said bottom wall.

There is also provided according to another aspect of the invention, a process for producing packs according to the invention.

The invention will now be further described, by way of example, with reference to the drawings, in which:

FIG. 1 shows a perspective view, partly cut away, of a pack according to the most preferred embodiment of the invention;

FIGS. 2*a*, 2*b* and 2*c* show sectional views of the pack of FIG. 1 in three stages of opening;

Figure 1:
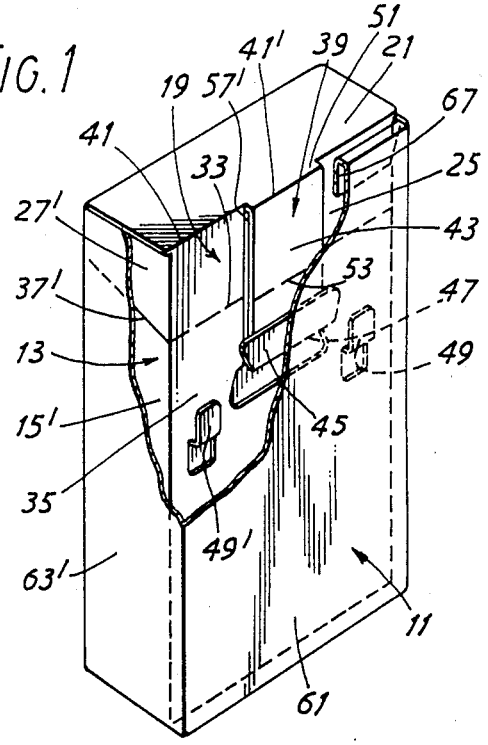

As can be seen in FIGS. 1, 2, 3 and 4 a pack according to the most preferred embodiment of the invention comprises an outer shell 11 in which slides an inner slide 13. The inner slide 13 comprises two side walls 15, 15', a front wall 17, a rear wall 19, a top wall 21 and a bottom wall 23. The top wall 21, together with an upper portion 25 of the rear wall 19 and upper portions 27, 27' of the side wall 15, 15' and lid reinforcing flaps 29, 29' and front flap 31 form a lid. The lid is hinged to the rest of the inner slide along a fold line 33 which separates the upper portion 25 of the rear wall 19 from the lower portion 35. The fold line 33 may be defined by a simple crease, or may be perforate. The upper portions 27, 27' of the side walls 15, 15' are each separated from the rest of the side wall by a cut 37, 37'.

In the embodiment shown, the lid of the inner slide 13 is held together by gluing the lid reinforcing flaps 29,29' in position. Optionally, however, the flap 31 may be folded onto the inner surface of the top wall 21, over the lid reinforcing flaps 29,29'. The flap 31 may be held in place by gluing, or by location of lugs on its short sides in slots formed in the fold lines between the lid reinforcing flaps 29,29' and the upper portions 27,27' of the side walls 15,15'. Alternatively, a lug may be provided on the free long side of the flap 31, for location in a slot in the fold line between the top wall 21 and the rear wall 19 of the inner slide 13. This arrangement removes the need for gluing of the lid reinforcing flaps 29,29'.

The rear wall 19 has a tongue 39 cut from it. The tongue is attached to the inner slide 13 at the fold line 41 at which the top wall 21 extends from the rear wall 19. The tongue 39 comprises an upper, narrow, portion 43 and a lower, wider, portion 45. The wider portion 45 is bent up along the fold line 47 to provide a first hook. This hook is prevented from falling inside the inner slide 13 when the pack is assembled by the lower, wider, portion 45. Optionally, an inner frame (not shown) may be provided inside the inner slide 13. This consists of a sheet of card adjacent the rear wall 19 of the inner slide which serves to ensure that the hook does not pass into the inner slide. Auxiliary stopping tabs 49, 49' may also be provided, on the rear wall 19 of the inner slide 13, somewhat below the level of the bottom of the tongue 39. These auxiliary stopping tabs are folded up to form hooks.

Figure 3:
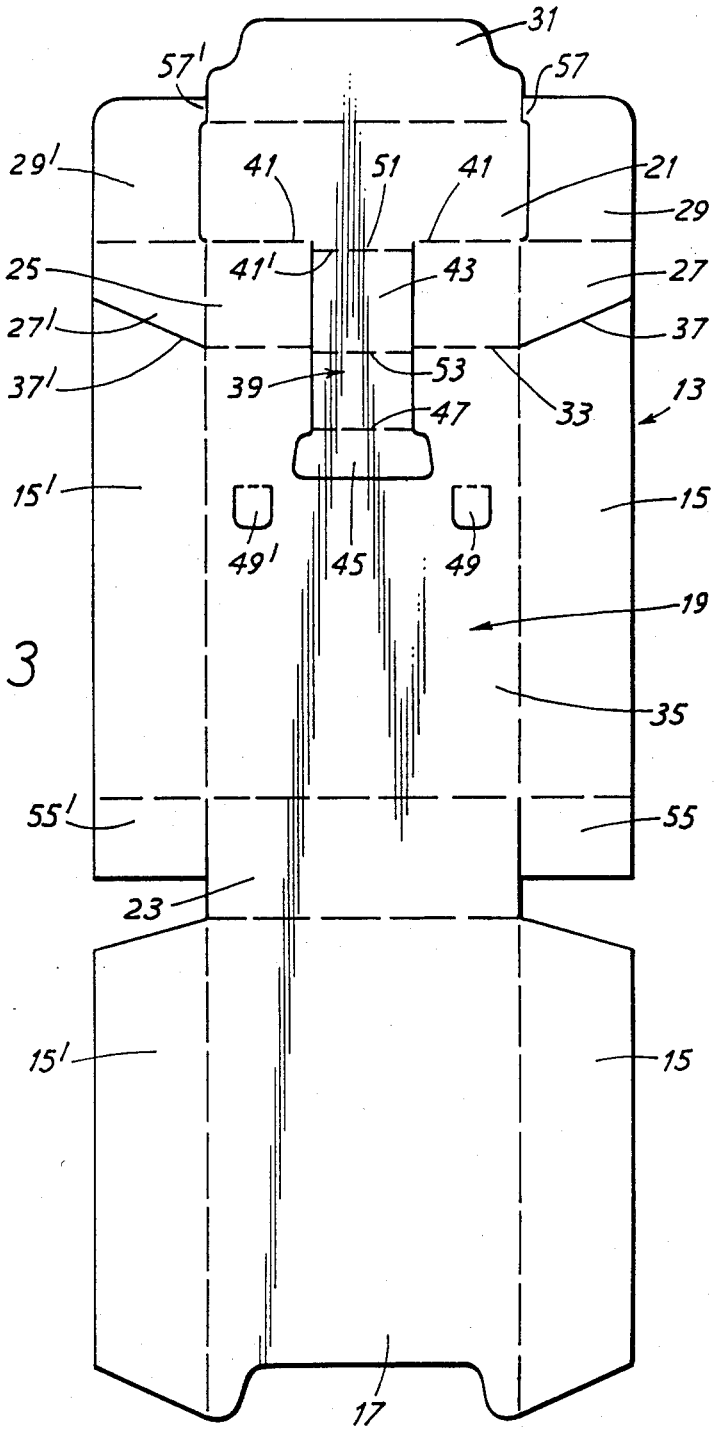
FIG. 3 is a plan view of a card blank from which the inner slide of the pack of FIGS. 1 and 2 is formed.
Figure 4:
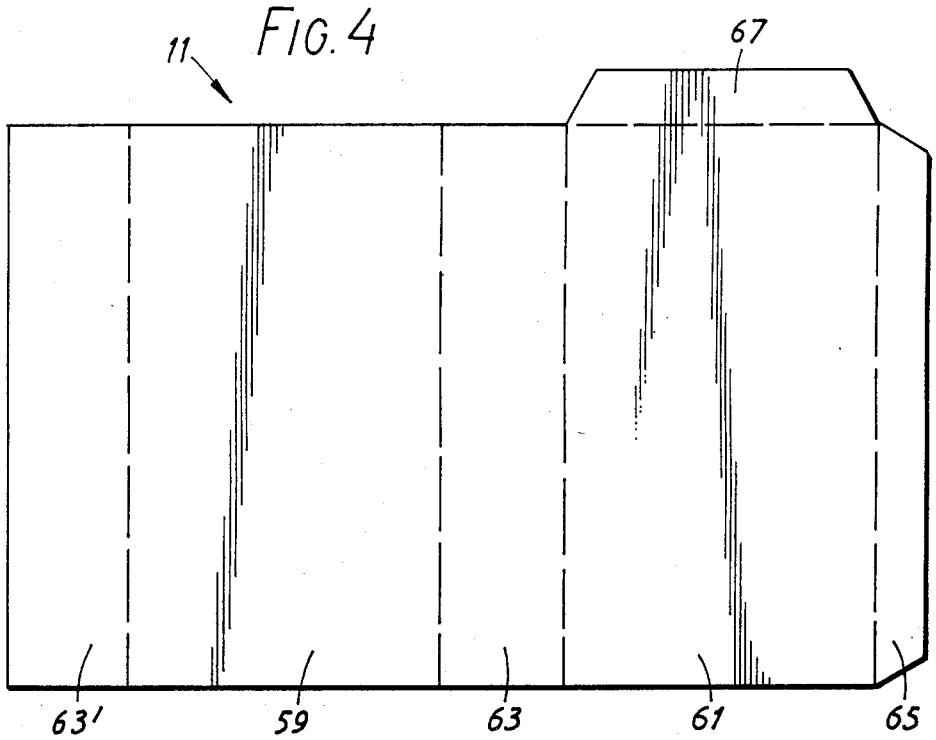
FIG. 4 is a plan view of the card blank from which the outer shell of FIGS. 1 and 2 is formed.

As is best seen in FIGS. 1 and 3, the tongue 39 is folded along a fold line 41' adjacent but below, by for example up to 2 mm, preferably by 1 mm, the fold line 41 between the top wall 21 of the rear wall 19 of the inner slide 30. This forms a lip 51 on the top wall 21 from which the tongue 39 depends. A further fold line 53 is also provided on the tongue 39, approximately half way down its upper, narrow, portion 43. Optionally, the tongue 39 may taper so that it is wider at its bottom end than it is at the fold line 41' at which it joins the top wall 21 of the inner slide 13.

Conventional bottom reinforcing flaps 55, 55' are provided, which, when the inner slide is assembled, may be glued in place, as may the lid reinforcing flaps 29, 29'. The lid reinforcing flaps 29, 29' are provided with extensions 57, 57' which, when the inner slide is assembled, lie under the lip 51 on the top wall 21 to reinforce it.

The outer shell 11 comprises a front wall 59, a rear wall 61 and side walls 63, 63'. A gluing flap 65 is provided on the free edge of the rear wall 61 to attach it to one of the side walls 63' a further flap 67 extends from the upper edge of the rear wall 61 of the outer shell. This flap, when the pack is assembled, is folded inside the outer shell 11 to provide a second hook.

Figure 2A:
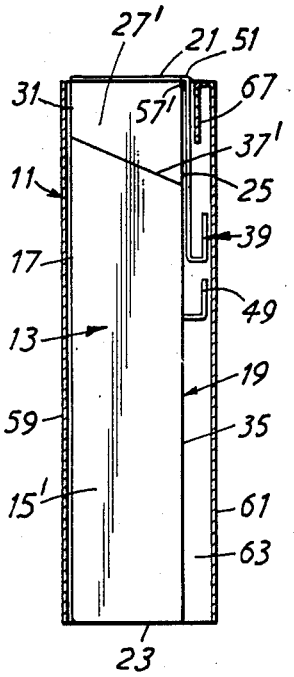
Figure 2B:
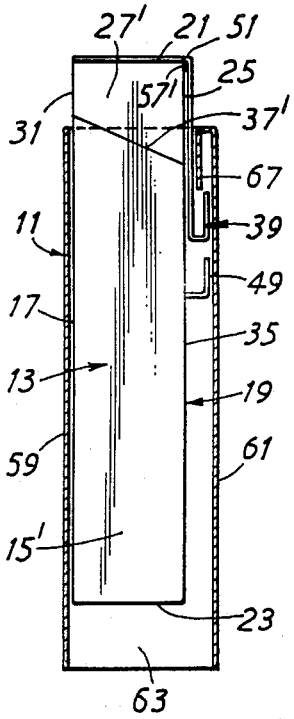
Figure 2C:
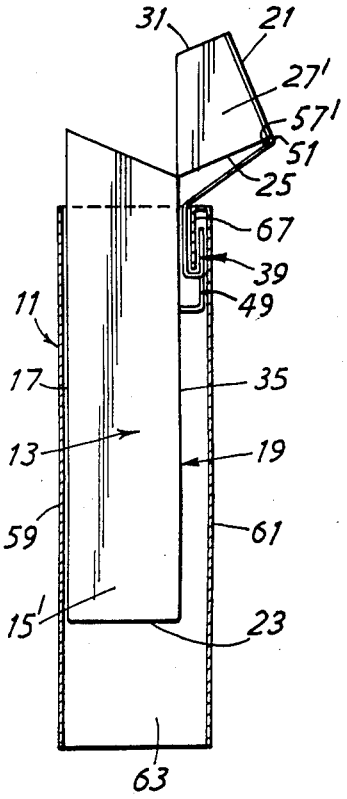

As can be seen from FIG. 2, as the inner slide 13 is urged up within the outer shell 11, in this case by pushing it through the open bottom of the outer shell, the first hook, on the inner slide 13, moves into engagement with the second, on the outer shell 11 (FIG. 2*b*). When the two hooks are fully engaged with each other (FIG. 2*c*) further upward pressure on the inner slide 13 causes, by means of the tongue 39 on the inner slide pivoting about the edge of the lip 51 on the top wall 21, the lid to open. At this point, as is shown in FIG. 2*c*, the tongue 39 is no longer aligned with the rear wall 19 of the inner slide 13. Instead, it rests against the upper edge of the rear wall 61 of the outer shell 11, and is bent along the fold line 53 which is approximately halfway down its narrow portion 43. The rest of the inner slide, containing cigarettes, continues to move upward in the outer shell 11, until the auxiliary stopping tabs 49, 49' also engage the second hook on the outer shell 11, causing upward movement to cease.

When the cigarette has been removed, the pack is closed by applying pressure to the top wall 21 of the inner slide 13. The lid is thus closed, and the inner slide 13 returns inside the outer shell 11.

It will be noted that the top wall 21 of the inner slide 13 is slightly wider than the rear wall 61 of the outer shell 11, to prevent the top wall 21 of the inner slide from moving inside the outer shell 11.

Figure 5:
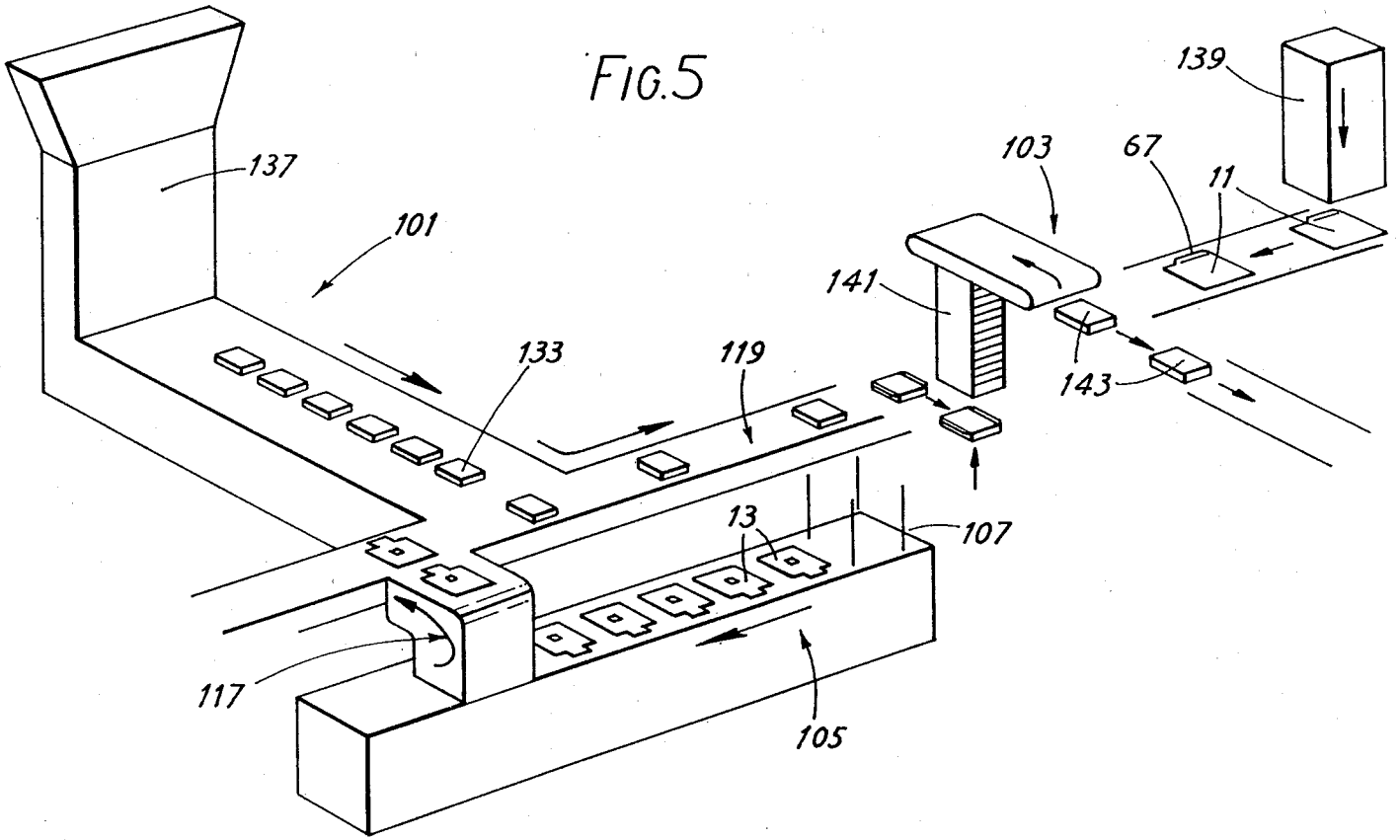
FIG. 5 is a diagrammatic representation of apparatus according to the invention.

Turning now to the apparatus for producing packs according to the invention, FIG. 5 is a diagrammatic representation of such apparatus. It will be seen that the apparatus consists of a novel hinged lid pack machine 101 and a slide and shell packer 103.

Figure 8:
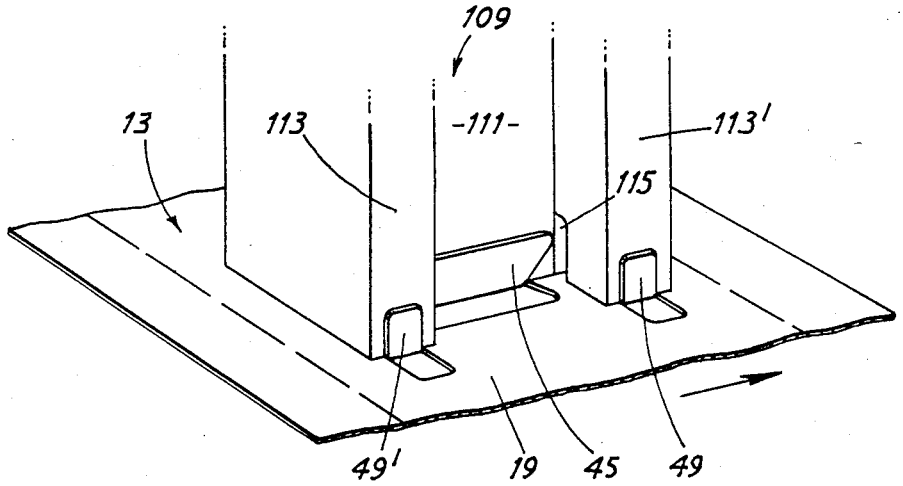
FIG. 8 shows a partial view of another part of the apparatus of FIG. 5.

The apparatus for producing the inner slides is similar to that used for the production of standard hinged lid cigarette packs, but incorporates novel features which form an aspect of the present invention. A hinged lid pack apparatus of a conventional type is described in British Pat. No. 508 466 of Chalmers and Molins Machine Company Limited (filed Aug. 30th 1938, published June 29th 1939). The hinged lid pack machine 101 comprises a blank bed 105 to which pre-cut and scored blanks for the inner slide 13 are supplied from a stack 107. The blanks 13 pass along the blank bed in the direction of the arrow in a generally conventional manner. However, during the passage of the blanks 13 the lower, wider, portions 45 of the tongues 39 and the auxiliary stopping tabs 49, 49' in the blanks are pushed up by appropriately placed prongs whilst the rest of the blank is held stationary. The device for performing this function is shown in FIG. 8. It consists of a shoe 109 which has a principal face 111 against which the lower portion 45 of the tongue 39 is pushed by a prong (not shown) moving up from below the blank bed 105. Two projections 113, 113' provide faces against which the auxiliary stopping tabs 49, 49' are pushed by prongs (also not shown).

The shoe 109 reciprocates up and down, to contact each blank 13 while the tongue and tabs are being pushed up by the prongs. As the blank moves off in the direction of the arrow, the wider portion 45 of the tongue 39 passes through a slot 115 cut in one of the projections 113' of the shoe 109. Alternatively, and advantageously, the shoe 109 can be reciprocated sufficiently rapidly to obviate the necessity for the slot 115.

As is well known, shoes are used in conventional apparatus for the production of ordinary hinged lid cigarette packs, to hold a blank whilst the front flap of the lid portion is folded up. Such a shoe is mounted on an arm which pivots to reciprocate the shoe. Such a shoe may be employed on apparatus of the type described herein, and advantageously the arm may be extended to carry in addition the tab forming shoe 109.

The wider portions 45 of the tongues 39 and auxiliary stopping tabs 49, 49' are then folded over to lie against the rear wall 19 of the inner slide blank 13 by a plough device, not shown.

The wider portions 45 of the tongues 39 and the auxiliary stopping tabs 49, 49' are then pressed firmly against the rear wall 19 of the inner slide blank by a press (not shown). This can conveniently be done while the blank is being printed with the information code normally appearing on cigarette packs.

From the blank bed 105, the blank 13 passes, by means of a band transfer 117 to a pocket on the sealer bed 119. Preferably, the band transfer 117 is provided with a delivery band which is approximately the same width as the rear wall 19 of the inner slide 13, so that the tabs 49, 49' and the tongue 39 are held in their folded position during transfer.

Figure 6:
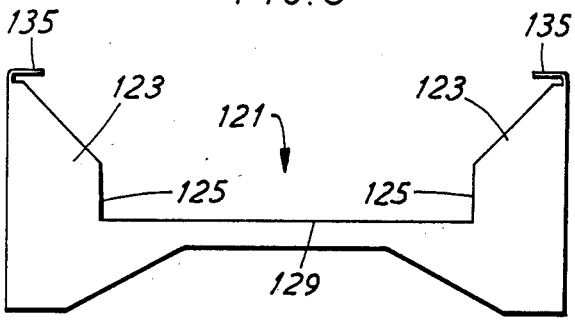
FIG. 6 is a cross sectional view of a pocket from the sealing bed of the apparatus of FIG. 4.
Figure 7:
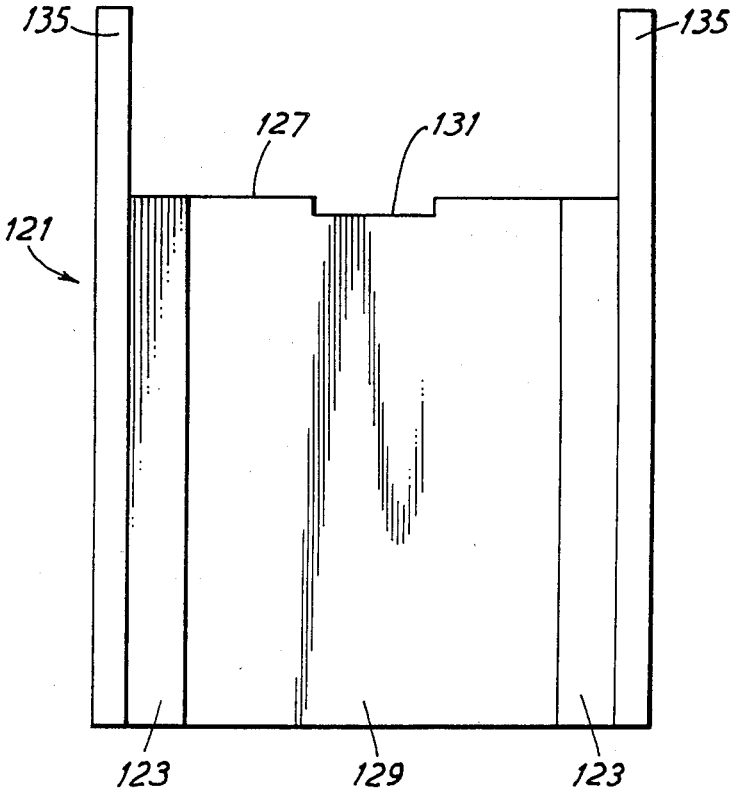
FIG. 7 is a plan view from above of the pocket of FIG. 6.

The sealer bed comprises a plurality of pockets, not shown in FIG. 5 but shown in section and plan in FIGS. 6 and 7 respectively. The pockets 121 for use with apparatus according to the present invention differ from conventional pockets in that the chamfered side walls 123 terminate in vertical portions 125. This allows, at a later stage in the production of the inner slides, for the slides to be ejected from the pockets without the top wall 21, which is wider than the rear wall 19, fouling the side wall of the pocket.

Further, the edge 127 of the lower surface 129 of the pockets 121 is formed with a notch 131 so that, when the blank 13 receives a bundle of cigarettes 133, and the blank is urged downwards against the edge 127 of the lower surface 129, the blank folds along both the fold line 41 between the top wall 21 and the rear wall 19 and the fold line 41' across the upper portion of the tongue 39, thus providing the lip 51 on the top wall 21. The pockets 121 are provided with retaining clips 135 for retaining the blank 13 therein.

Cigarettes are supplied from a hopper 137, and wrapped in foil to form bundles 133 in a known manner on a filler bed 139.

The bundles move from the filler bed, by way of a filler bed extension, to enter a blank 13 which has been formed into a pocket 121. The blank is folded around the bundle 133 in a substantially conventional manner.

The slide and shell pack 103 comprises a shell magazine 139 which supplies flat glued outer shell blanks 11 to a plough device (not shown) which opens the blank and folds the flap 67 extending from the upper edge of the rear wall 61 of the outer shell inside the outer shell.

A dry stack 141 is also provided, into which the filled inner slides 13 pass. A heater in the dry stack 141 cures the adhesive used in the assembly of the slide. From the dry stack, the filled inner slides 13 are moved inside the open outer shells 11 to form the complete pack 143.

The complete packs are then conveyed to a station, not shown, for storage and further packing.

I claim:

1. A pack of smoking articles comprising an inner slide and an outer shell, said inner slide comprising:

a bottom wall;

opposed side walls and a rear wall extending from said bottom wall and comprising upper and lower portions, said rear wall having an upper edge; and a top wall attached to said upper edge of said rear wall along a first fold line, said top wall forming, together with said upper portion of said rear wall, a lid;

wherein a first tongue is formed of both said upper and lower portions of said rear wall and is attached to said inner slide at its upper end, said first tongue having upper and lower ends, said lower end of said tongue being folded toward said lid to form a first hook, said first tongue being formed of an upper tongue portion and a lower tongue portion wider than said upper tongue portion, and wherein said lower tongue portion is folded towards said lid of said inner slide to form said first hook; and said outer shell comprising opposed side shell walls and opposed front and rear shell walls, and a flap extending from said upper edge of said rear shell wall folded inside said shell to form a second hook for engagement with said first hook of said inner slide, whereby, when said inner slide is inside said outer shell and is moved upwards, said first hook engages said second hook to cause said lid of said inner slide to open along a second fold line extending across said rear wall of said inner slide between said upper and lower portions thereof.

2. A pack according to claim 2 wherein a front flap depends from the front edge of said top wall of said inner slide.

3. A pack according to claim 1 wherein said top wall of said inner slide is wider than said rear wall of said outer shell, for preventing said top wall of said inner slide from passing into said outer shell.

4. A pack of smoking articles comprising an inner slide and an outer shell, said inner slide comprising:

a bottom wall;

opposed side walls and a rear wall extending from said bottom wall and comprising upper and lower portions, said rear wall having an upper edge; and a top wall attached to said upper edge of said rear wall along a first fold line, said top wall forming, together with said upper portion of said rear wall, a lid;

wherein a first tongue is formed of both said upper and lower portions of said rear wall and is attached to said inner slide at its upper end, said first tongue having upper and lower ends, said lower end of said tongue being folded toward said lid to form a first hook, said first tongue being attached to said inner slide at said first fold line, and wherein said first fold line, where it crosses said first tongue, is displaced toward said lower portion of said rear wall of said inner slide, whereby said top wall of said inner slide is provided, on its rear edge, with a protruding lip from which said first tongue depends; and said outer shell comprising opposed side shell walls and opposed front and rear shell walls, and a flap extending from said upper edge of said rear shell wall folded inside said shell to form a second hook for engagement with said first hook of said inner slide, whereby, when said inner slide is inside said outer shell and is moved upwards, said first hook engages said second hook to cause said lid of said inner slide to open along a second fold line extending across said rear wall of said inner slide between said upper and lower portions thereof.

5. A pack according to claim 4 wherein said lid of said inner slide is provided with a reinforcing piece extending under said lip.

6. A pack according to claim 2 wherein a front flap depends from the front edge of said top wall of said inner slide.

7. A pack according to claim 2 wherein said top wall of said inner slide is wider than said rear wall of said outer shell, for preventing said top wall of said inner slide from passing into said outer shell.

8. A pack of smoking articles comprising an inner slide and an outer shell, said inner slide comprising:

a bottom wall;

opposed side walls and a rear wall extending from said bottom wall and comprising upper and lower portions, said rear wall having an upper edge; and a top wall attached to said upper edge of said rear wall along a first fold line, said top wall forming, together with said upper portion of said rear wall, a lid;

wherein a first tongue is formed of both said upper and lower portions of said rear wall and is attached to said inner slide at its upper end, said first tongue having upper and lower ends, said lower end of said tongue being folded toward said lid to form a first hook, a further tongue being formed in said lower portion of said rear wall of said inner slide and being bent portion of said rear wall of said inner slide and being bent toward said lid of said inner slide to form a stopping tab for engagement with said second hook on said rear wall of said outer shell when said lid is fully opened; and said outer shell comprising opposed side shell walls and opposed front and rear shell walls, and a flap extending from said upper edge of said rear shell wall folded inside said shell to form a second hook for engagement with said first hook of said inner slide, whereby, when said inner slide is inside said outer shell and is moved upwards, said first hook engages said second hook to cause said lid of said inner slide to open along a second fold line extending across said rear wall of said inner slide between said upper and lower portions thereof.

9. A pack according to claim 8 wherein a front flap depends from the front edge of said top wall of said inner slide.

10. A pack according to claim 8 wherein said top wall of said inner slide is wider than said rear wall of said outer shell, for preventing said top wall of said inner slide from passing into said outer shell.

* * * * *

UNITED STATES PATENT AND TRADEMARK OFFICE

CERTIFICATE OF CORRECTION

PATENT NO. : 4,646,960

DATED : March 3, 1987

INVENTOR(S) : Ian Challand

It is certified that error appears in the above-identified patent and that said Letters Patent is hereby corrected as shown below:

Claim 2, line 1, "2" should be -- 1 --.

Claim 6, line 1, "2" should be -- 4 --.

Claim 7, line 1, "2" should be -- 4 --.

Claim 8, line 18, "portion of said rear wall of said" should be deleted;

line 19, "inner slide and being" should be deleted.

Signed and Sealed this

Sixteenth Day of February, 1988

*Attest:*

*Attesting Officer*

DONALD J. QUIGG

*Commissioner of Patents and Trademarks*